US008346134B2

(12) United States Patent
Nakayama et al.

(10) Patent No.: US 8,346,134 B2
(45) Date of Patent: Jan. 1, 2013

(54) DEVELOPING DEVICE AND IMAGE FORMING APPARATUS THAT INCLUDE A DEVELOPER TRANSPORT AMOUNT REGULATION PART

(75) Inventors: Masayoshi Nakayama, Tokyo (JP); Yoshitaka Fujinuma, Tokyo (JP); Susumu Takeyama, Tokyo (JP); Tatsuya Kubo, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/269,916

(22) Filed: Oct. 10, 2011

(65) Prior Publication Data

US 2012/0027466 A1 Feb. 2, 2012

Related U.S. Application Data

(63) Continuation of application No. 12/251,580, filed on Oct. 15, 2008, now Pat. No. 8,045,893.

(30) Foreign Application Priority Data

Oct. 22, 2007 (JP) ..... 2007-274185

(51) Int. Cl.
*G03G 15/08* (2006.01)

(52) U.S. Cl. ..... 399/254; 399/260

(58) Field of Classification Search ..... 399/254
See application file for complete search history.

(56) References Cited

U.S. PATENT DOCUMENTS

2007/0025773 A1* 2/2007 Tateyama et al. ..... 399/254
2007/0274742 A1 11/2007 Nakayama et al.
2007/0280744 A1 12/2007 Kubo et al.
2008/0101818 A1 5/2008 Shimojima et al.
2008/0187332 A1* 8/2008 Tsuda et al. ..... 399/27
2008/0199205 A1 8/2008 Kubo et al.
2008/0199223 A1* 8/2008 Tateyama et al. ..... 399/254

FOREIGN PATENT DOCUMENTS

JP 2007-272201 10/2007

OTHER PUBLICATIONS

Japanese Office Action dated May 15, 2012, issued for Japanese Patent Application No. 2007-274185. (2 pages).

* cited by examiner

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

A developing device that can discharge developer by an amount of developer in the developing device increased by a carrier supplemented into the developing device includes a supply transport screw and a receiving transport screw in a top and bottom positional relationship, the rotational axes of the supply transport screw and the receiving transport screw are mutually parallel in relation to an image support member. The developing device also includes an inclined transport screw arranged at an incline between one end of the supply transport screw and an other end of the receiving transport screw. The developing device also includes a supply unit for supplying new carrier into a casing and a discharge port and discharge unit for discharging part of the developer housed in the casing to the outside, the discharge port provided on a part of the casing corresponding to an upper part of the inclined transport screw.

32 Claims, 4 Drawing Sheets

DEVELOPING DEVICE AND IMAGE FORMING APPARATUS THAT INCLUDE A DEVELOPER TRANSPORT AMOUNT REGULATION PART

CROSS REFERENCE TO RELATED APPLICATION

The present continuation application claims the benefit of priority under 35 U.S.C. 120 to application Ser. No. 12/251,580, filed Oct. 15, 2008 now U.S. Pat. No. 8,045,893, and claims the benefit of priority under 35 U.S.C. 119 from Japanese Application No. 2007-274185, filed on Oct. 22, 2007. application Ser. No. 12/251,580 is hereby incorporated by reference in its entirety.

BACKGROUND OF THE INVENTION

1. Field of the Invention

The present invention relates to a developing device that supplies developer to a developer support member such as a developing sleeve while transporting the developer by a transport screw, and to an image forming apparatus using this developing device.

2. Description of the Related Art

Well-known in the past were developing devices using developer containing toner and magnetic carrier that, as developer is transported in the axial linear direction of rotation based on a supply transport screw arranged on the side of the developer support member, developer is supplied to the full longitudinal region of the developer support member. In this type of developing device, while the supply transport screw supplies developer to the developer support member, developer after participating in development is recovered from the developer support member. Then, developer transported to the downstream terminal in the supply direction of the supply transport screw is transferred by a separate transport screw. Next, after being transported while mixing with supplemental toner, the transferred developer is returned to the upstream terminal in the supply direction of the supply transport screw.

By conducting this kind of developer recirculation transport, as developer with the toner concentration depleted by development is recovered from the developer support member, developer that has had the toner concentration restored with supplemental toner can be supplied to the developer support member.

Nonetheless, in the related configuration the developer concentration is depleted little by little from the upstream to the down stream developer transport direction of the supply transport screw. Most of the developer in the system is the developer immediately after concentration restoration, and the percentage of used developer recovered from the developer support member goes on increasing in the vicinity the upstream terminal in the developer transport direction of the supply transport screw, as it turns to faces downstream in the developer transport direction.

Meanwhile, developing devices (called one-directional circulation systems) that recover developer from the developer support member and supply developer to the developer support member by separate transport screws are also well-known. One-directional circulation systems can suppress development concentration irregularities in the developer transport direction because used developer from the developer support member is not returned to the supply transport screw and the toner concentration of the developer on the supply transport screw can by stabilized in the developer transport direction.

For example, described in Japanese Laid-open Patent Publication No. 2001-249545 is a configuration that realizes a one-directional recirculation system having a supply transport screw that supplies developer to a developer support member, a receiving transport screw arranged directly below, and an inclined transport screw arranged at the side of these vertically aligned screws and oriented at an incline in relation to horizontal. In this configuration, the receiving transport screw restores the toner concentration by supplementing the used developer received from the developer support member with toner, and then transfers the developer to the inclined transport screw. The inclined transport screw transports the developer sent from the receiving transport screw at a rising grade to the supply transport screw arranged directly above the receiving screw.

In addition, in conventional image forming apparatuses such as copiers and printers, technology that suitably supplies new carrier to the developing device that houses 2 component developer comprising toner and carrier (called a "premix developing system") is well-known, for example, Japanese Laid-open Patent Publication No. 2001-183893.

In the normal developing process, the carrier in two component developer housed in the developing device remains in the developing device without being consumed, and therefore the carrier deteriorates over time. Carrier deterioration modes include: film loss, in which the coating layer of the carrier is abraded or peels off and the charge capacity of the carrier drops, and spent, in which components and additives of the toner adhere to the surface of the carrier and the charge capacity of the carrier decreases. The premix developing system is for the purpose of preventing a reduction of image quality of the output image caused by this kind of carrier deterioration over time, and by suitably supplementing new carrier (or new two component developer) into the developing device and suitably discharging part of the two component developer inside the developing device to outside of the developing device, this system reduces the amount of deteriorated carrier inside the developing device and maintains the amount and charge capacity of carrier housed inside the developing device.

Japanese Laid-open Patent Publication No. 2006-063645 is an example disclosing an apparatus that uses a premix developing system in the one-directional circulating system of the developing device disclosed in the previously described Japanese Laid-open Patent Publication No. 2001-249545. In this type of developing device, a developer discharge port is provided on the downstream side of the supply transport screw, and when the surface of the developer transported to that location exceeds a specified height, that developer (the excess amount of developer due to the supplementation of carrier) overflows and is discharged to outside of the developing device.

In the configuration described in the previously described Japanese Laid-open Patent Publication No. 2006-063645, which uses a premix developing system in a developing device with a one-directional recirculating system, a developer discharge port is provided on the casing side surface part equivalent to the downstream side of the supply transport screw, but in a developing device with a one-directional recirculating system the used developer from the developer support member is not returned to the supply transport screw, and therefore the amount of developer of the supply transport screw part on the downstream side of the supply transport screw is reduced and the surface of the developer becomes low.

Because that position is one in which it is difficult for the height of the surface of the developer to reflect the amount of developer in the developing device and also because in this configuration the developer at that position is discharged from the aforementioned discharge port, and no matter the amount of developer in the developing device, there is the problem that a phenomenon is produced in which the developer that is kicked up by the screw blade is directly discharged from the discharge port, and the amount of developer in the developing device is prone to fluctuate. If the amount of developer in the developing device is not stable, the amount of developer supplied to the developer support member becomes unstable, and deteriorated images are produced in which auger pitch irregularities are generated on the output image.

SUMMARY OF THE INVENTION

In view of the foregoing background, it is an object of the present invention to provide a developing device and image forming apparatus that, even when adopting a premix developing system in a developing device with a one-directional recirculation system, discharges a suitable amount of surplus developer in the developing device, stably maintains the amount of developer in the developing device, and stabilizes the quality of the output images. It is a further object to provide a compact developing device and image forming apparatus by arranging in a spatially efficient manner the discharge mechanism of the surplus developer.

In an aspect of the present invention, a developing device develops a latent image formed on an image support member using developer containing toner. The developing device comprises at least three transport screws that are provided in a casing and rotate about a rotational axis for agitating and transporting the developer. The at least three transport screws comprises a supply transport screw and a receiving transport screw, the rotational axes of which are mutually parallel in relation to the image support member and which are arranged in a top and bottom positional relationship, and an inclined transport screw which is arranged at an incline between one end of the supply transport screw and the other end of the receiving transport screw. The developing device further comprises a supply device for supplying new carrier into the casing; and a discharge port and a discharge device for discharging part of the developer housed in the casing to the outside. The discharge port is provided on the part of the casing corresponding to the upper part of the inclined transport screw.

In another aspect of the present invention, an image forming apparatus comprises a developing device that develops a latent image formed on an image support member using developer containing toner. The developing device has at least three transport screws that are provided in a casing and rotate about a rotational axis for agitating and transporting the developer. The at least three transport screws comprises a supply transport screw and a receiving transport screw, the rotational axes of which are mutually parallel in relation to the image support member and which are arranged in a top and bottom positional relationship, and an inclined transport screw which is arranged at an incline between one end of the supply transport screw and the other end of the receiving transport screw. The developing device further comprises a supply device for supplying new carrier into the casing; and a discharge port and a discharge device for discharging part of the developer housed in the casing to the outside. The discharge port is provided on the part of the casing corresponding to the upper part of the inclined transport screw.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(S)

An embodiment of a color laser printer of an electronic photographic system (simply called a "printer" below) will be explained below as an image forming apparatus that applies the developing device of the present invention.

First the basic configuration of a printer related to the present embodiment will be explained.

Figure 1:
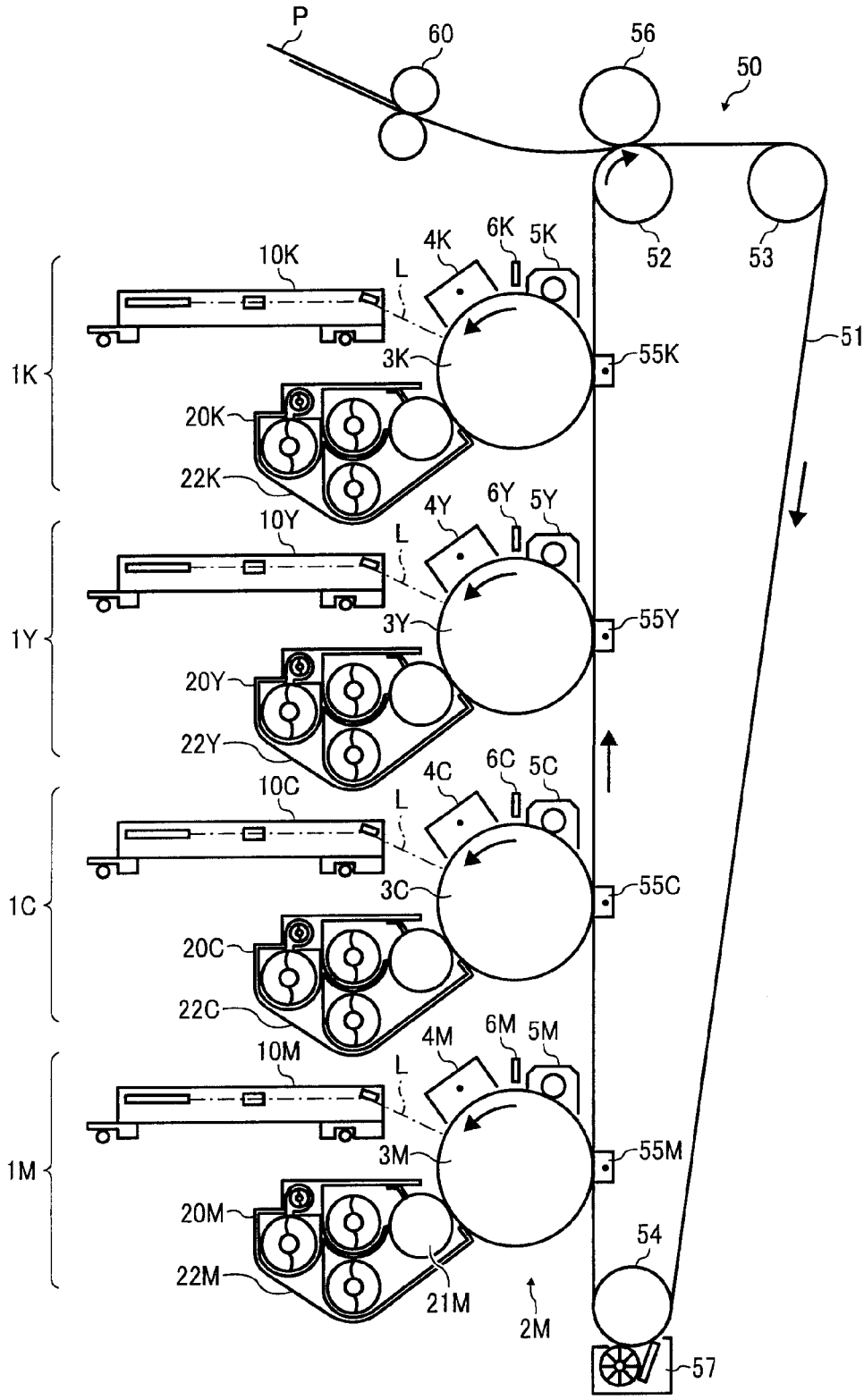
FIG. 1 is a diagram indicating an overall configuration of the essential parts of a printer related to an embodiment of the present invention.

FIG. 1 is an overall configuration diagram indicating the essential parts of a printer (image forming unit) related to the present embodiment. This printer is provided with four toner image forming parts 1M, 1C, 1Y, and 1K for forming toner images of the colors magenta, cyan, yellow and black respectively (abbreviated M, C, Y, and K below). In addition, transfer unit 50 is provided on the side of these toner image forming units 1M, 1C, 1Y, and 1K, that are mutually arranged in a vertical line.

The toner image forming units 1M, 1C, 1Y, and 1K have nearly the same configurations other than different toner colors being used. Describing the M toner image forming unit 1M for forming M toner images, the toner image forming unit 1M has a process unit 2M, an optical writing unit 10M, and a developing unit (developing device) 20M.

The M process unit 2M has a uniform charge device 4M, a drum cleaning device 5M, a neutralization lamp 6M, and the like on the periphery of a drum shaped photosensitive body 3M that is rotationally driven counterclockwise in the diagram; and these are supported in a common casing and can be attached and detached as a single unit in relation to the printer proper. The photosensitive body 3M is a tube made of aluminum or the like covered with an organic photosensitive layer.

The uniform charge device 4M uses a corona charger to provide, for example, a uniform negative charge to the surface of the photosensitive body 3M that is rotationally driven counterclockwise in the diagram.

The optical writing unit 10M has a light source comprising a laser diode or the like, a positive hexahedral polygon mirror, a polygon motor for rotationally driving the same, an fθ lens, a lens, a reflective mirror and the like. Based on image data sent from a personal computer or the like not indicated in the diagram, laser light L emitted from the light source is reflected by the surface of the polygon mirror, is polarized as the polygon mirror rotates, and arrives at the photosensitive body 3M. The surface of the photosensitive body 3M is thereby optically scanned, and an electrostatic latent image for M is formed on the surface of the photosensitive body 3M.

The M developing unit (developing device) 20M has a developing roller 21M part of the peripheral surface of which is exposed from an opening provided in the casing. This developing roller 21M has a developing sleeve comprising a non-magnetic pipe that is rotationally driven by drive means not indicated in the diagram, and a magnetic roller not indicated in the diagram enclosed inside so as not to rotate with the sleeve. M developer, not indicated in the drawing, that contains a magnetic carrier and negatively charged M toner is enclosed inside the casing 22M of the developing unit 20M.

While the M toner undergoes friction charging by being agitated and transported by the transport screw, which is arranged inside the same casing and will be described later, this M developer adheres to and spikes up on the developer sleeve surface, which the developing roller 21M rotates, based on the magnetic force of the magnetic roller in the developing roller 21M. The layer thickness is regulated as the developing sleeve rotates and passes through the position opposing a developing doctor 25M, and then the developer is transported to the developing region facing the photosensitive body 3M.

At this developing region, developing potential, which electrostatically moves the negative polarity M toner from the sleeve side to the latent image side, acts between the electrostatic image on the photosensitive body 3M and the developing sleeve, onto which is applied a negative polarity developing bias output from a power source not indicated in the diagram. In addition, non-developing potential, which electrostatically moves the negative polarity M toner from the background part side to the sleeve side, acts between the developing sleeve and the uniformly charged locations (background parts) of photosensitive body 3M.

The M toner in the M developer on the developing sleeve peels off from on top of the sleeve by the action of the developing potential and transfers to the electrostatic latent image of the photosensitive body 3M. The electrostatic latent image on the photosensitive body 3M is developed into the M toner image by this transfer. Further, as the developing sleeve rotates, M developer, which has had the M toner consumed by developing, is returned to inside the casing. Moreover, the M toner image on the photosensitive body 3M undergoes intermediate transfer onto an intermediate transfer belt 51 of the transfer unit 50 to be described later.

The developing unit 20M has a toner concentration sensor not indicated in the diagram that constitutes a magnetic permeability sensor. This toner concentration sensor outputs voltage of a value corresponding to the magnetic permeability of the M developer that is housed in the developer recovery chamber, to be described later, of the developing unit 20M. The magnetic permeability of the developer is a satisfactory indication of the toner concentration of the developer, and therefore the toner concentration sensor outputs voltage of a value corresponding to the toner concentration. The value of this output voltage is sent to a toner supplementation control unit not indicated in the diagram. This toner supplementation control unit is provided with memory means such as RAM, and stored therein are M Vtref, which is the target value of the output voltage from the M toner concentration sensor, and C, Y, and M Vtref data, which are the target values of the output voltages from the toner concentration sensors mounted in the other developing units.

Regarding the developing unit 20M for M, the M Vtref is compared with the value of the output voltage from the M toner concentration sensor, and an M toner supplementation device not indicated in the diagram is driven for a time just corresponding to the comparison results. Thus, the M toner for supplementation is thereby supplemented into the developing unit.

By controlling (toner supplementation control) the drive of the M toner supplementation device in this way, a suitable amount of M toner is supplemented into the M developer that has undergone the drop in M toner concentration associated with developing, and the M toner concentration of the M developer in the developing unit 20M is maintained within a specified range. Further, the developing units 20C, 20Y, and 20K conduct similar toner supplementation control.

Here, the developing unit 20M of the present embodiment is a premix developing system, and the toner supplementation device that supplements toner into the casing 22M functions as supply means for supplementing new carrier into the casing; and thus new carrier is suitably supplemented into the developing unit 20M, and deteriorated developer is discharged to outside the developing unit 20M. As a carrier supplementation method, new carrier of a fixed percentage is premixed into the supplementary toner in the toner supplementation device, and may be supplemented simultaneously when conducting the previously described toner supplementation; or the system may be configured such that the new carrier is housed in a chamber separate from the toner for supplementation housed inside the toner supplementation device, and, corresponding to the integrated value of the drive time of the developing unit, only the carrier is supplemented at a timing different from that of the toner.

The M toner image developed on the photosensitive body 3M is transferred to the surface of the intermediate transfer belt 51 to be described later. The transfer residual toner that was not transferred onto the intermediate transfer belt 51 adheres to the surface of the photosensitive body 3M that has undergone the transfer process. This transfer residual toner is removed by a drum cleaning device not indicated in the diagram. The surface of the photosensitive body 3M that has had the transfer residual toner removed in this way is neutralized by a neutralization lamp 6M, and subsequently is uniformly charged by the uniform charge device 6K.

The M toner image forming unit 1M was explained in detail, but the toner image forming units 1C, 1Y and 1K of the other colors also form C, Y, and K toner images on the surfaces of the photosensitive bodies 3C, 3Y, and 3K by the same process.

In the diagram, the transfer unit 50 is arranged on the right side of the toner image forming units 1M, 1C, 1Y, and 1K that are mutually arranged in a vertical line. This transfer unit 50 has a drive roller 52 on the inside of the loop of an endless intermediate transfer belt 51, a tension roller 53, and a driven roller 54. Then, while the intermediate transfer belt 51 is stretched over these three rollers, the rotational drive of the drive roller 52 causes endless movement in the clockwise direction of the diagram. In the diagram, the left side of the stretched surface of the intermediate transfer belt 51 that is endlessly driven in this way makes contact with the photosensitive bodies 3M, 3C, 3Y, and 3K respectively for M, C, Y, and K, and thereby primary transfer nips for M, C, Y, and K are formed.

In addition to the three rollers described above, four transfer chargers 55M, 55C, 55Y, and 55K are arranged inside the loop of the intermediate transfer belt 51. These transfer chargers 55M, 55C, 55Y, and 55K are arranged such that they impart a charge on the back surface of the intermediate transfer belt 51 at the back side of the primary transfer nips for M, C, Y, and K. By imparting this charge, opposing transfer electric fields that cause electrostatic movement of toner from the photosensitive bodies 3M, 3C, 3Y, and 3K side to the belt surface side is formed inside the primary transfer nips for M, C, Y, and K. Further, a transfer roller that applies a transfer bias may be used by substituting the transfer charger of a corona charger system.

At the primary transfer nips of each color, the M, C, Y, and K toner images formed on the photosensitive bodies 3M, 3C, 3Y, and 3K of the various colors are moved from the photosensitive body side to the belt surface side by the nip pressure and the effect of the transfer electric field, and are thus laminated and transferred onto the intermediate transfer belt 51. A four-color laminated toner image (called "four-color toner image" below) is thereby formed on the intermediate transfer belt 51.

At the location where the intermediate transfer belt 51 is hung on and rotated by the drive roller 52, a secondary transfer bias roller 56 makes contact from the belt outer surface side, thereby forming a secondary transfer nip. Secondary transfer bias is applied to this secondary transfer bias roller 56 by voltage application means composed of a power source and wiring not indicated in the diagram. A secondary transfer electric field is thereby formed between the secondary transfer bias roller 56 and the grounded drive roller 52. The four-color toner image formed on the intermediate transfer belt 51 proceeds into the secondary transfer nip as the belt endlessly moves.

The present printer is provided with a paper feed cassette not indicated in the diagram, and recording paper P is housed therein in the form of a stack of multiple pages of recording paper. Then, the topmost recording paper P is sent out on the paper feed circuit at a specified timing. The recording paper P sent out enters in between a pair of resist rollers 60 arranged at the end of the paper feed route.

Both rollers of the pair of resist rollers 60 are rotationally driven in order to pinch the recording paper P sent out from the paper feed cassette between the rollers, but once the end of the recording paper P is pinched, the rotational drive of the two rollers is terminated. Then, the recording paper P is sent out facing the secondary transfer nip at a timing that can be synchronized with the four-color toner image onto the intermediate transfer belt 51. At the secondary transfer nip, secondary transfer of the four-color toner image on the intermediate transfer belt 51 is conducted in one batch based on the action of the secondary transfer electric field and the nip pressure. Then, incorporating the white of the recording paper P, this becomes a full color image. After being discharged from the secondary transfer nip, the recording paper P on which a full color image is formed in this way is sent to a fixing device not indicated in the diagram, and the full color image is fixed.

The secondary transfer residual toner adhering to the surface of the intermediate transfer belt 51 after passing through the secondary nip is removed from the belt surface by a belt cleaning device 57 that pinches the intermediate transfer belt 51 between the cleaning device itself and the driven roller 54.

Figure 2:
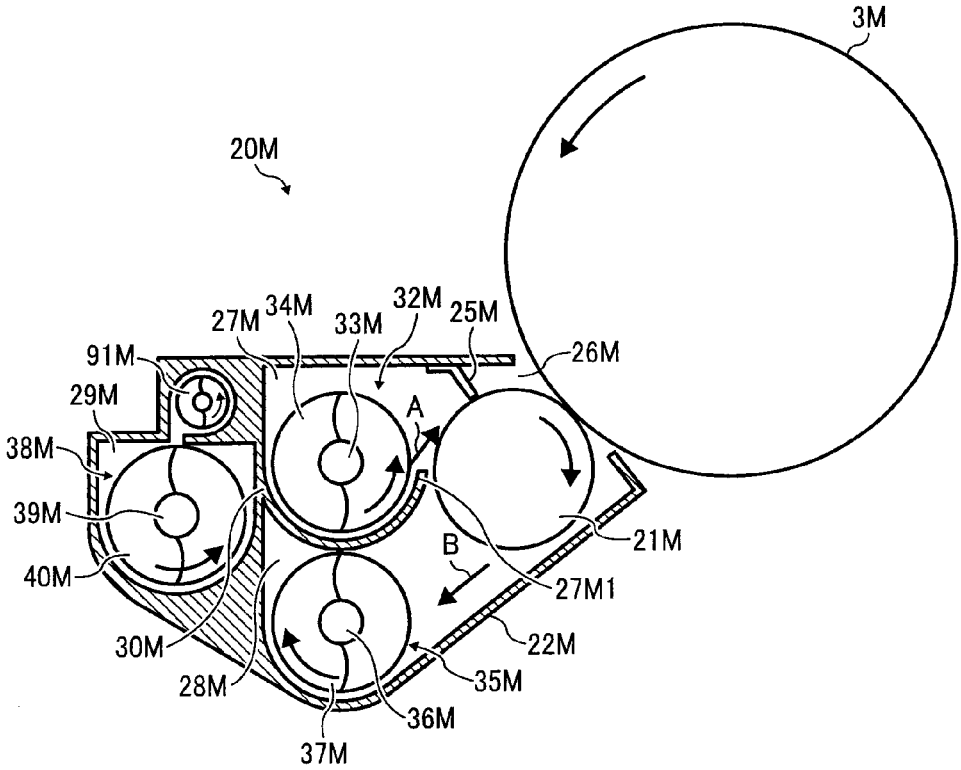
FIG. 2 is a diagram indicating a configuration of a developing unit and photosensitive body of the M (magenta) toner image forming part of the same printer.

FIG. 2 indicates the configuration of the developing unit (developing device) 20M and the photosensitive body 3M of the toner image forming unit for M (1M). In the same diagram, the drum-shaped photosensitive body 3M is arranged in an orientation that extends along the axial linear direction thereof orthogonal to the surface of the diagram paper. The casing 22M of the developing unit 20M has a developing chamber 26M, a developer supply chamber 27M, a developer recovery chamber 28M, and a developer return chamber 29M; and the M developer not indicated in the diagram is housed in these various chambers. Moreover, the previously described developing roller 21M is rotatably housed in the developing chamber 26M. A supply transport screw 32M is rotatably housed in the developer supply chamber 27M. A receiving transport screw 35M is rotatably housed in the developer recovery chamber 28M. In addition, an inclined transport screw 38M is rotatably housed in the developer return chamber 29M.

As described above, the developing roller 21M has a developing sleeve comprising a non-magnetic pipe that is rotationally driven peripherally clockwise in the diagram by drive means composed of a motor and drive transmission not indicated in the diagram, and, connected to this, a magnetic roller not indicated in the diagram enclosed inside so as not to rotate with the sleeve.

The developing chamber 26M that houses the developing roller 21M has an opening in the wall on the side facing the photosensitive body 3M, and part of the peripheral surface of the developing sleeve is exposed therefrom. On the side of this developing chamber 26M opposite the side facing the photosensitive body 3M, the developer supply chamber 27M and the developer recovery chamber 28M connect through across the entire region in the axial linear direction of the developing roller 21M. The developer supply chamber 27M is vertically arranged immediately above the developer recovery chamber 28M, and both of the developer supply chamber 27M and the developer recovery chamber 28M connect through to the developing chamber 26M across the entire lengthwise region on the right side of the diagram (photosensitive body side).

The supply transport screw 32M housed in the developer supply chamber 27M has an orientation that extends horizontally in the same way as the photosensitive body 3M and the developing roller 21M. Then, a rod-shaped rotating shaft member 33M and a screw blade 34M set up spirally on the peripheral surface thereof are rotationally driven as a single unit in the counterclockwise direction in the diagram by drive means composed of a motor and drive transmission system not indicated in the diagram.

The receiving transport screw 35M housed in the developer recovery chamber 28M also has an orientation that extends horizontally in the same way as the photosensitive body 3M, the developing roller 21M and the supply transport screw 32M. Then, a rotating shaft member 36M and a screw blade 37M are rotationally driven as a single unit in the clockwise direction in the diagram by drive means not indicated in the diagram.

The developer return chamber 29M is near the side of the developer supply chamber 27M and developer recovery chamber 28M opposite to the developing chamber 26M. This developer return chamber 29M is different from the other chambers, and is formed with an orientation that extends at an incline from horizontal. Then, the inclined transport screw 38M, which has a screw blade 40M set up on the peripheral surface of a rotating shaft member 39M, also extends inside of this developer return chamber 29M at an orientation sloping up and down, and is rotationally driven counterclockwise in the diagram by drive means not indicated in the diagram. Further, the majority of the developer return chamber 29M is divided from the developer supply chamber 27M and the developer recovery chamber 28M by a dividing wall 30M. However, part of the developer return chamber 29M is connected with the developer supply room 27M and the developer recovery chamber 28M by an opening 31M provided in the dividing wall 30M.

Figure 3:
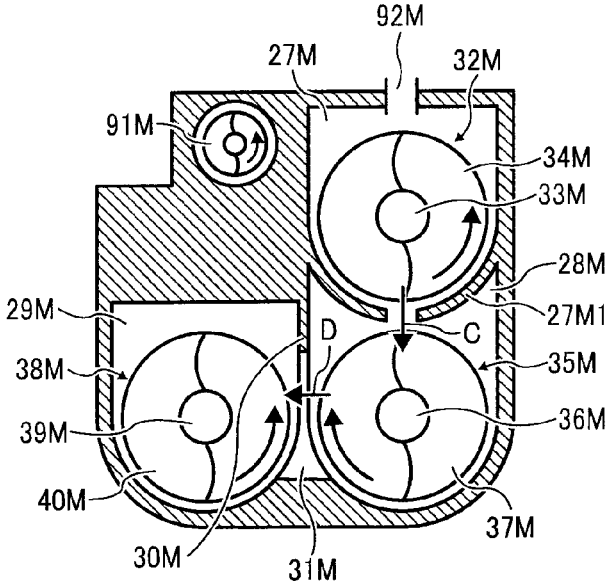
FIG. 3 is a longitudinal cross-sectional diagram indicating one terminal side of the same developing unit.

Inside the developer supply chamber 27M, the M developer (not indicated in the diagram), which is supported in the blade of the supply transport screw 32M, is transported from the front side to the depth side in the direction orthogonal to the surface of the diagram paper as the supply transport screw 32M rotates. In this transport process, the M developer is successively supplied to the developing sleeve inside the developing chamber 26M as indicated by the arrow A in the diagram, and spikes up on the developing sleeve based on the magnetic force of the magnetic roller inside the developing roller 21M. The M developer transported to the vicinity of the downstream side end in the direction of developer transport (vicinity of terminal at the back side in the diagram) of the supply transport screw 32M without spiking up on the developing sleeve falls into the developer recovery chamber 28M from a drop-in opening provided on a bottom wall 27M-1 of the developer supply chamber 27M as indicated by the arrow C in FIG. 3 that shows the back side.

In FIG. 2, the remaining M developer, which was transported up to the developing area as the developing screw rotated and then participated in developing, is subsequently transported to the connection position between the developing chamber 26M and the developing recovery chamber 28M as the developing sleeve rotates. After separating from the sleeve surface based on the effect of the repelling magnetic field that the aforementioned magnetic roller forms, the remaining developer falls down into the developer recovery chamber 28M as indicated by the arrow B in the diagram.

Inside the developer recovery chamber 28M, the M developer (not indicated in the diagram) that is supported inside the blade of the receiving transport screw 35M is transported from the front side to the depth side in the direction orthogonal to the surface of the diagram paper as the receiving transport screw 35M rotates. In this transport process, M toner is supplemented by the previously described toner supplementation device. Moreover, the M developer that falls in from the aforementioned drop-in opening provided on the bottom wall 27M-1 of the developer supply chamber 27M is taken in. Afterwards, the M developer transported to the vicinity of the downstream side end in the direction of developer transport (vicinity of terminal in the depth direction the diagram) of the receiving transport screw 35M proceeds into the developer return chamber 29M through an opening in the dividing wall 30M as indicated by the arrow D in FIG. 3.

The M developer that has proceeded into the developer return chamber 29M is incorporated into the upstream side end (lower end) in the direction of developer transport of the inclined transport screw 38M. Then, aligned in an orientation facing in a upward slope from the upstream side in the direction of developer transport toward the downstream side in the direction of developer transport, the inclined transport screw 38M rotates, and the developer is transported at a rising grade as indicated by the arrow G in FIG. 4. When the M developer is transported to the vicinity of the downstream side end in the direction of developer transport of the inclined transport screw 38M, the developer passes through a return opening 42M provided in the dividing wall 30M, and is returned to the developer supply chamber 27M as indicated by arrow H in FIG. 5. Then, the developer is incorporated into the upstream side end in the direction of developer transport of the supply transport screw 32M. Further, the region indicated by the code W in FIG. 4 indicates the image formation capable region in the axial linear direction of the photosensitive body.

In the present printer having the basic configuration described above, the four photosensitive bodies 3M, 3C, 3Y, and 3K each function as a latent image support member that supports a latent image on a surface that endlessly moves by rotation. Moreover, the optical writing units 10M, 10C, 10Y, and 10K function as latent image forming means that forms a latent image on the surface of the photosensitive body after uniform charging. In addition, the various color developing units 20M, 20C, 20Y, and 20K function as developing devices that develop latent images on the surfaces of the photosensitive bodies 3M, 3C, 3Y, and 3K respectively.

Next, a configuration characteristic of the present printer will be explained.

As described above, the developing unit of the present printer is a premix developing system, new carrier is suitably supplemented inside the developing unit 20M, and deteriorated developer is discharged to outside the developing unit 20M. In the present embodiment, a discharge port 90M for the deteriorated developer is provided in the casing corresponding to the upper part of the inclined transport screw 38M, specifically, in the upper wall part 29M-1, and is in a position that does not face the tangential direction 94M of the circumscribed circle of the inclined transport screw 38M; and a section of the developer return chamber 29M (developer transport amount regulation part 93M), which has a smaller volume than the volumes at other sections of the developer return chamber 29M, is provided on the downstream side from the discharge port 90M in the developer transport direction of the inclined transport screw 38M.

In other words, the developer transport amount regulation part 93M is provided such that the volume of the space formed by the inclined transport screw 38M and the upper wall part 29M-1 (flow route width) is smaller (narrower) than that on the downstream side of the discharge port 90M.

Further, the formation position, shape, and opening surface area of the discharge port 90M are provided on the casing corresponding to the upper part of the inclined transport screw 38M at a position, etc. that suitably reflect the increase of the amount of developer in the developing unit based on the supplemented carrier, and are also at a position such that the developer kicked up by the inclined transport screw 38M, specifically, the developer kicked up in the tangential direction of the circumscribed circle of the inclined transport screw 38M, does not proceed directly into the discharge port.

A toner and carrier supplementation port (92M in FIG. 3) is provided in the vicinity of the downstream side terminal in the direction of developer transport of the supply transport screw 32M (outside of image formation capable region W); and here the supplemented toner or carrier drops in from the aforementioned drop-in opening of the developer supply chamber 27M to the vicinity of the downstream side terminal in the direction of developer transport of the receiving transport screw 35M, subsequently passes through the opening 31M of the dividing wall 30M, and is transferred into the developer return chamber 29M (housing part of the inclined transport screw).

The M developer that proceeds into the developer return chamber 29M is incorporated into the upstream side terminal in the direction of developer transport of the inclined transport screw 38M. Then, as the inclined transport screw 38M, which is arranged in an upward incline from the upstream side in the direction of developer transport to the downstream side in the direction of developer transport, rotates, the developer is transported at a rising grade as indicated by arrow G in FIG. 4, and is transported to the vicinity of the developer discharge port 90M. During this time, the carrier supplemented by the supplementation port 92M passes through the aforementioned route to arrive at the discharge port 90M, and is thoroughly mixed with the developer inside the developing unit.

The developer transport amount regulation part 93M for decreasing the volume of part of the developer return chamber 29M (the space between the casing inner wall and the inclined transport screw 38M) is provided on the interior wall of the casing 22M at a position on the downstream side from the discharge port 90M in the direction of transport of the inclined transport screw 38M. In the developer transport amount regulation part 93M that is provided on the downstream side from the discharge port 90M in the direction of transport of the inclined transport screw 38M, the amount of developer that passes through is regulated by the volume (the space between the casing inner wall and the inclined transport screw) of the partially narrowed developer return chamber 29M, and the excess developer is stopped in the vicinity of the discharge port 90M. When carrier is supplemented and the amount of developer in the developing unit increases, the surface of the developer in the vicinity of the discharge port 90M rises, and developer is taken into the discharge port 90M and is transported to outside the developing unit by the developer discharge means 91M.

In the configuration in question, the discharge port 90M is provided at a position that suitably reflects the increase in the amount of developer in the developing unit based on the supplemented carrier and also at a position where the developer kicked up in the tangential direction of the circumscribed circle of the inclined transport screw 38M does not proceed directly to the discharge port, and therefore only the portion of the developer inside the developing unit increased by the carrier supplemented into the developing unit can be discharged from the developing unit.

In addition, irrespective of the increase in the amount of developer inside the developing unit based on carrier supplementation, based on the developer transport amount regulation part 93M, a fixed amount of developer is sent to the supply transport screw 32M part that kicks up developer to the developing sleeve, and therefore the amount of developer kicked up to the developing sleeve can be stably maintained, and generation of image deterioration such as auger pitch irregularities can be prevented.

Figure 4:
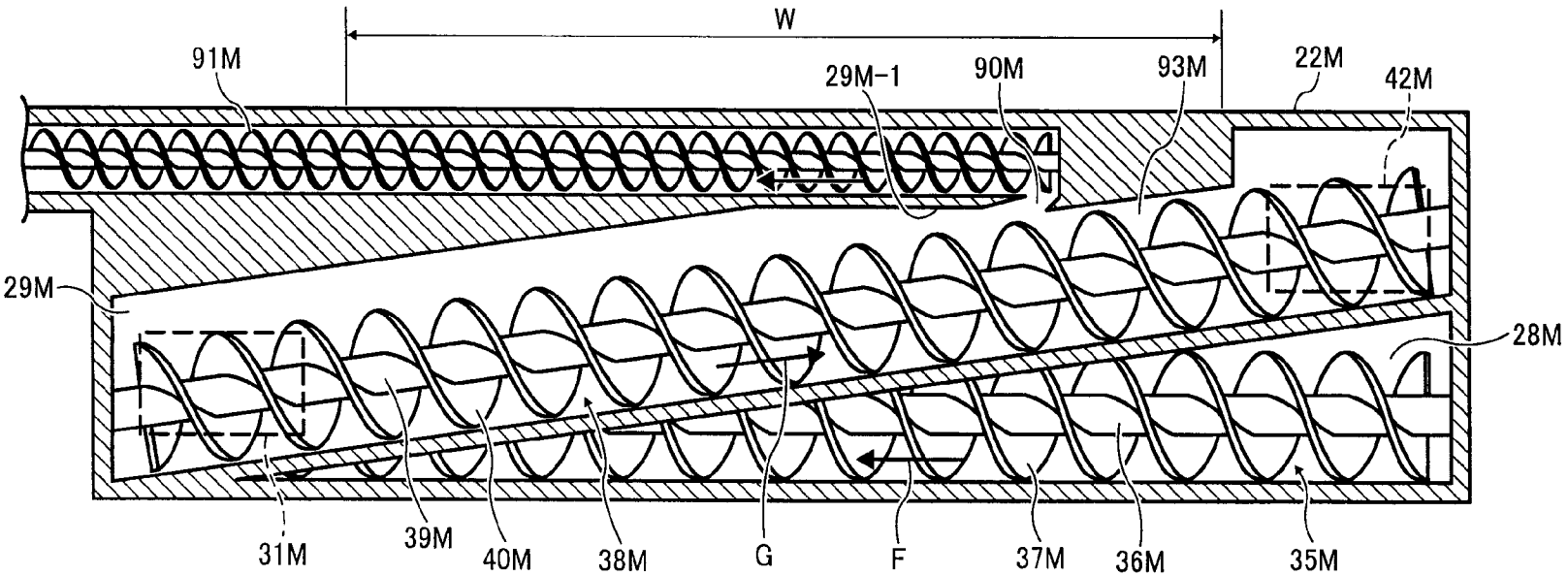
FIG. 4 is a longitudinal cross-sectional diagram indicating a side part of the same developing unit.
Figure 5:
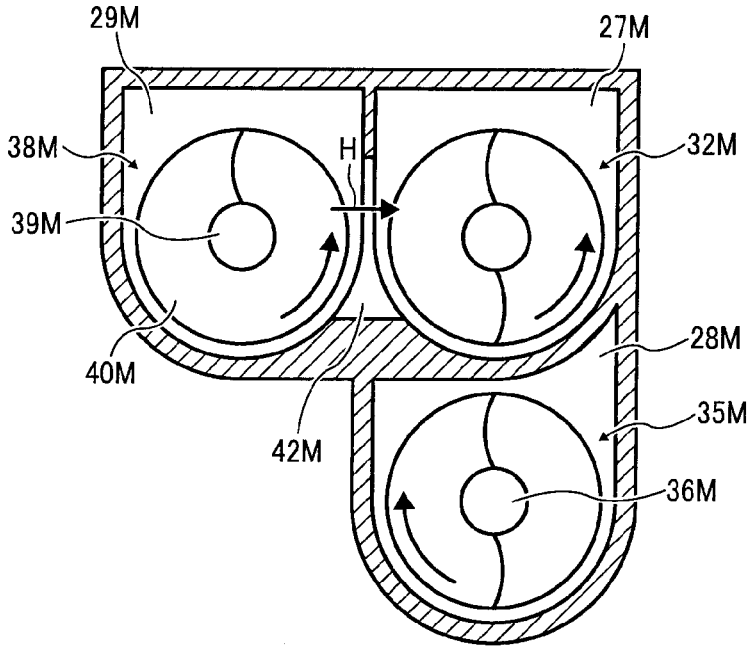
FIG. 5 is a horizontal cross-sectional diagram indicating the other terminal side of the same developing unit.
Figure 6:
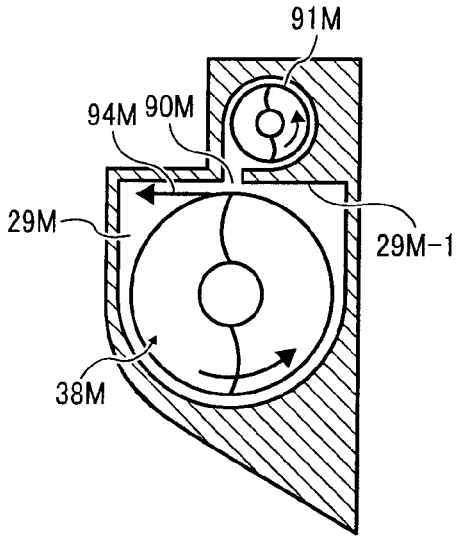
FIG. 6 is a diagram indicating one part near the discharge port of the developer return chamber of the same developing unit.

Here, the developer discharge means 91M is positioned is a space formed above the inclined transport screw 38M, and is provided parallel with the shaft of the inclined transport screw 38M in the front and back direction (depth direction in FIG. 4). In this configuration, because the developer discharge means 91M is originally set up in a dead space of the inclined transport screw 38M (in the thick part of upper wall of the casing 22M), the outer dimensions of the developing unit do not increase by adding the developer discharge means 91M. Therefore, the developing unit can be efficiently arranged within the image forming apparatus as a whole, and a compact image forming apparatus can be made.

In the description above, an explanation was given of a so-called tandem system printer that can obtain full color images by laminating and transferring various color toner images formed by multiple toner image forming units, but the present invention could also be applied to an image forming apparatus that forms full color images using a single system. This single system is one in which a plurality of developing means for the various colors are arranged on the periphery of a latent image support member such as a photosensitive body, and the visible image of each color formed on the latent image support member is successively laminated and transferred as the developing means used is successively switched. Moreover, the present invention may also be applied to an image forming apparatus that forms only monochrome images.

As described above, the present invention has the following advantages.

(1) Even if a premix developing system is used in a developing device with a one-directional recirculating system, a suitable amount of excess developer in the developing device can be discharged, the amount of developer in the developing device can be stably maintained, and a developing device and image forming apparatus with stable quality of the output image can be offered. Furthermore, by efficiently arranging the space of the mechanism for discharging excess developer, a compact developing device and image forming apparatus can be offered.

(2) Because the discharge port is provided at a position that suitably reflects the increase of the amount of developer in the developing unit (developing device) based on the newly supplemented carrier in the casing, and is also at a position where the developer kicked up in the tangential direction of the circumscribed circle of the inclined transport screw does not proceed directly into the discharge port, only the amount of developer in the developing unit increased by the carrier supplemented to the developing unit can be suitably discharged from the developing unit.

(3) Because a fixed amount of developer is sent to the transport screw part that kicks up developer to the developing sleeve irrespective of the increase of the amount of developer inside the developing unit based on supplementing carrier, the characteristics of developer being kicked up to the developing sleeve can be stably maintained, and the generation of deteriorated images such as auger pitch irregularities can be prevented.

(4) Because developer discharge means is installed in the dead space above the inclined transport screw, the outer dimensions of the developing unit can be made small, and the overall shape of the image forming apparatus can be made compact.

Various modifications will become possible for those skilled in the art after receiving the teachings of the present disclosure without departing from the scope thereof.

What is claimed is:

1. A developing device comprising:

a developer retaining member that develops a latent image formed on an image retaining member using developer containing toner;

at least three transport screws that are provided in a casing and rotate about a respective rotational axis for agitating and transporting the developer, said at least three transport screws including, a supply transport screw that supplies the developer to the developer retaining member, a receiving transport screw that receives the developer from the developer retaining member, wherein the rotational axes of the supply transport screw and the receiving transport screw are mutually parallel in relation to the image retaining member, and an agitating transport screw that receives the developer from the receiving transport screw, agitates the developer and transports the developer to the supply transport screw;

a supply port that receives new carrier into the casing;

a discharge port and discharge device that discharge part of the developer housed in the casing to an outside of the developing device; and a developer transport amount regulation part provided on a downstream side from the discharge port in a direction of transport of the agitating transport screw that decreases a volume of part of a space between an interior wall of the casing and the agitating transport screw.

2. The developing device as claimed in claim 1, wherein the agitating transport screw is arranged so as to be inclined in the casing.

3. The developing device as claimed in claim 1, wherein the discharge port is provided on the casing adjacent to an upper part of the agitating transport screw.

4. The developing device as claimed in claim 1, wherein the developer transport amount regulation part is a protrusion from the interior wall of the casing.

5. The developing device as claimed in claim 1, wherein said three screws are arranged to be separately partitioned by the interior wall of the casing.

6. The developing device as claimed in claim 1, wherein the developer transport amount regulation part is disposed such that a space formed by the agitating transport screw and the inner wall is narrower than that on the downstream side of the discharge port.

7. The developing device as claimed in claim 1, wherein the discharge device is disposed within a wall of the casing.

8. The developing device as claimed in claim 1, wherein the discharge device is a screw.

9. An image forming apparatus comprising:

an image retaining member;

a developing device that develops a latent image formed on the image retaining member using developer containing toner, said developing device including at least three transport screws that are provided in a casing and rotate about a respective rotational axis for agitating and transporting the developer, wherein said at least three transport screws include, a supply transport screw that supplies the developer to the developer retaining member, a receiving transport screw that receives the developer from the developer retaining member, wherein the rotational axes of the supply transport screw and the receiving transport screw are mutually parallel in relation to the image retaining member, and an agitating transport screw that receives the developer from the receiving transport screw, agitates the developer and transports the developer to the supply transport screw;

a supply port that receives new carrier into the casing;

a discharge port and discharge device that discharge part of the developer housed in the casing to an outside of the device; and a developer transport amount regulation part provided on a downstream side from the discharge port in a direction of transport of the agitating transport screw that decreases the volume of part of a space between an interior wall of the casing and the agitating transport screw.

10. The image forming apparatus as claimed in claim 9, wherein the agitating transport screw is arranged so as to be inclined in the casing.

11. The image forming apparatus as claimed in claim 9, wherein the discharge port is provided on the casing adjacent to an upper part of the agitating transport screw.

12. The image forming apparatus as claimed in claim 9, wherein the developer transport amount regulation part is a protrusion from the interior wall of the casing.

13. The image forming apparatus as claimed in claim 9, wherein said three screws are arranged to be separately partitioned by the interior wall of the casing.

14. The image forming apparatus as claimed in claim 9, wherein the developer transport amount regulation part is disposed such that a space formed by the agitating transport screw and the inner wall is narrower than that on the downstream side of the discharge port.

15. The image forming apparatus as claimed in claim 9, wherein the discharge device is disposed within a wall of the casing.

16. The image forming apparatus as claimed in claim 9, wherein the discharge device is a screw.

17. A developing device comprising:

a developer retaining member that develops a latent image formed on an image retaining member using developer containing toner;

at least three transport screws that are provided in a casing and rotate about a respective rotational axis for agitating and transporting the developer, said at least three transport screws including, a supply transport screw that supplies the developer to the developer retaining member, a receiving transport screw that receives the developer from the developer retaining member, wherein the rotational axes of the supply transport screw and the receiving transport screw are mutually parallel in relation to the image retaining member, and an agitating transport screw that receives the developer from the receiving transport screw, agitates the developer and transports the developer to the supply transport screw;

a supply port that receives new carrier into the casing;

a discharge port and discharge device that discharge part of the developer housed in the casing to an outside of the developing device; and a developer transport amount regulation part that is provided on a downstream side of the agitating transport screw in a direction of developer transport of the agitating transport screw and at a position on an upstream side of a return opening provided in a dividing wall of the casing for transferring the developer from the agitating transport screw into the supply transfer screw so as to decrease a volume of part of a space between an interior wall of the casing and the agitating transport screw.

18. The developing device as claimed in claim 17, wherein the agitating transport screw is arranged so as to be inclined in the casing.

19. The developing device as claimed in claim 17, wherein the discharge port is provided on the casing adjacent to an upper part of the agitating transport screw.

20. The developing device as claimed in claim 17, wherein the developer transport amount regulation part is a protrusion from the interior wall of the casing.

21. The developing device as claimed in claim 17, wherein said three screws are arranged to be separately partitioned by the interior wall of the casing.

22. The developing device as claimed in claim 17, wherein the developer transport amount regulation part is disposed such that a space formed by the agitating transport screw and an inner wall is narrower than that on the downstream side of the discharge port.

23. The developing device as claimed in claim 17, wherein the discharge device is disposed within a wall of the casing.

24. The developing device as claimed in claim 17, wherein the discharge device is a screw.

25. An image forming apparatus comprising:

an image retaining member;

a developing device that develops a latent image formed on the image retaining member using developer containing toner, said developing device including at least three transport screws that are provided in a casing and rotate about a respective rotational axis for agitating and transporting the developer, wherein said at least three transport screws include, a supply transport screw that supplies the developer to a developer retaining member, a receiving transport screw that receives the developer from the developer retaining member, wherein the rotational axes of the supply transport screw and the receiving transport screw are mutually parallel in relation to the image retaining member, and an agitating transport screw that receives the developer from the receiving transport screw, agitates the developer and transports the developer to the supply transport screw;

a supply port that receives new carrier into the casing;

a discharge port and discharge device that discharge part of the developer housed in the casing to an outside of the device; and a developer transport amount regulation part that is provided on a downstream side of the agitating transport screw in a direction of developer transport of the agitating transport screw and at a position on an upstream side of a return opening provided in a dividing wall of the casing for transferring the developer from the agitating transfer screw into the supply transport screw so as to decrease the volume of part of a space between an interior wall of the casing and the agitating transport screw.

26. The image forming apparatus as claimed in claim 25, wherein the agitating transport screw is arranged so as to be inclined in the casing.

27. The image forming apparatus as claimed in claim 25, wherein the discharge port is provided on the casing adjacent to an upper part of the agitating transport screw.

28. The image forming apparatus as claimed in claim 25, wherein the developer transport amount regulation part is a protrusion from the interior wall of the casing.

29. The image forming apparatus as claimed in claim 25, wherein said three screws are arranged to be separately partitioned by the interior wall of the casing.

30. The image forming apparatus as claimed in claim 25, wherein the developer transport amount regulation part is disposed such that a space formed by the agitating transport screw and an inner wall is narrower than that on the downstream side of the discharge port.

31. The image forming apparatus as claimed in claim 25, wherein the discharge device is disposed within a wall of the casing.

32. The image forming apparatus as claimed in claim 25, wherein the discharge device is a screw.

* * * * *